US008528644B2

(12) United States Patent
Brunet et al.

(10) Patent No.: US 8,528,644 B2
(45) Date of Patent: Sep. 10, 2013

(54) APPARATUS AND METHOD FOR MILLING CASING IN JET DRILLING APPLICATIONS FOR HYDROCARBON PRODUCTION

(75) Inventors: Charles Brunet, Houston, TX (US); Michel Bouchard, Calgary (CA)

(73) Assignee: Radjet LLC, Houston, TX (US)

( * ) Notice: Subject to any disclaimer, the term of this patent is extended or adjusted under 35 U.S.C. 154(b) by 530 days.

(21) Appl. No.: 12/682,959

(22) PCT Filed: Oct. 21, 2008

(86) PCT No.: PCT/US2008/080630

§ 371 (c)(1),
(2), (4) Date: Apr. 14, 2010

(87) PCT Pub. No.: WO2009/055380

PCT Pub. Date: Apr. 30, 2009

(65) Prior Publication Data

US 2010/0224367 A1 Sep. 9, 2010

Related U.S. Application Data

(60) Provisional application No. 60/999,723, filed on Oct. 22, 2007.

(51) Int. Cl.

| | |
|---|---|
| ***E21B 29/00*** | (2006.01) |
| ***E21B 43/11*** | (2006.01) |
| ***E21B 7/04*** | (2006.01) |
| ***E21B 7/08*** | (2006.01) |

(52) U.S. Cl.

USPC ..... 166/298; 166/55.2; 175/61; 175/73; 175/75; 175/78

(58) Field of Classification Search

USPC ..... 166/298, 55.2; 175/61, 73, 75, 76, 175/78

See application file for complete search history.

(56) References Cited

U.S. PATENT DOCUMENTS

| | | | | |
|---|---|---|---|---|
| 4,007,797 | A * | 2/1977 | Jeter | 175/26 |
| 4,693,327 | A * | 9/1987 | Dickinson et al. | 175/61 |
| 5,687,806 | A * | 11/1997 | Sallwasser et al. | 175/62 |
| 5,692,565 | A * | 12/1997 | MacDougall et al. | 166/264 |
| 5,853,056 | A * | 12/1998 | Landers | 175/424 |
| 6,109,368 | A | 8/2000 | Goldman et al. | |
| 6,189,629 | B1 * | 2/2001 | McLeod et al. | 175/67 |
| 6,209,645 | B1 | 4/2001 | Ohmer | |
| 6,257,353 | B1 * | 7/2001 | Belew et al. | 175/2 |

(Continued)

FOREIGN PATENT DOCUMENTS

WO 2007067544 A2 6/2007

*Primary Examiner* — David Andrews
*Assistant Examiner* — Michael Willis, III
(74) *Attorney, Agent, or Firm* — McGarry Bair PC

(57) ABSTRACT

An apparatus and method for improving control over the milling force applied to a milling bit that is turned through a rotary drive to form a hole in a wellbore casing. A bit-weighting sub is applied between the tubing used to lower the rotary drive's motor into the wellbore and the rotary drive itself, the sub serving to take the weight of the tubing off the rotary drive when the motor lands in operative connection with the drive, and further serving to apply a known milling force to the drive (and thus to the bit) independent of the weight of the tubing. In a preferred form the sub includes a spring that is compressed against the drive when the tubing and motor are landed.

12 Claims, 5 Drawing Sheets

(56) References Cited

U.S. PATENT DOCUMENTS

| | | | | |
|---|---|---|---|---|
| 6,276,453 | B1 * | 8/2001 | Bond | 166/313 |
| 6,283,230 | B1 * | 9/2001 | Peters | 175/67 |
| 6,571,867 | B2 * | 6/2003 | Bond | 166/50 |
| 6,578,636 | B2 * | 6/2003 | Mazorow et al. | 166/298 |
| 6,920,945 | B1 * | 7/2005 | Belew et al. | 175/67 |
| 6,964,303 | B2 * | 11/2005 | Mazorow et al. | 166/298 |
| 7,083,010 | B2 * | 8/2006 | Eppink et al. | 175/325.2 |
| 2002/0023781 | A1 * | 2/2002 | Peters | 175/67 |
| 2002/0108787 | A1 * | 8/2002 | Baird | 175/78 |
| 2005/0150692 | A1 | 7/2005 | Ballantyne et al. | |
| 2006/0162962 | A1 | 7/2006 | Koederitz et al. | |
| 2006/0169495 | A1 * | 8/2006 | Kolle | 175/61 |
| 2007/0151766 | A1 * | 7/2007 | Butler et al. | 175/67 |
| 2008/0000694 | A1 * | 1/2008 | Butler et al. | 175/67 |
| 2008/0115940 | A1 * | 5/2008 | Brunet et al. | 166/298 |

* cited by examiner

APPARATUS AND METHOD FOR MILLING CASING IN JET DRILLING APPLICATIONS FOR HYDROCARBON PRODUCTION

CROSS-REFERENCE TO RELATED APPLICATIONS

This application is a National Phase application of International Application No. PCT/US2008/080630, filed Oct. 21, 2008, which claims the benefit of U.S. Provisional Application No. 60/999,723, filed Oct. 22, 2007, both of which are incorporated herein by reference in their entirety.

BACKGROUND OF THE INVENTION

1. Field of the Invention

The invention relates to apparatus and methods for milling holes in wellbore casings of the type used for hydrocarbon production, and especially those wellbores in which coiled tubing is used to initially lower a milling device and subsequently lower a jet drilling hose to the bottom of the wellbore. In one of its aspects, the invention relates to a method and an apparatus for transferring a known amount of weight to a bit to mill a hole in a wellbore casing. In another of its aspects, the invention relates to a method and an apparatus for milling a hole in a wellbore casing in a relatively quick and cost effective manner. In another of its aspects, the invention relates to a method and an apparatus for milling a hole in a wellbore casing that is deviated. In another of its aspects, the invention relates to a method and an apparatus for milling a hole in a wellbore casing at greater depths than heretofore possible. In another of its aspects, the invention relates to a method and an apparatus for milling a hole in a wellbore casing wherein the skill of the operator in controlling the operating tools is lessened. In another of its aspects, the invention relates to a method and an apparatus for milling a hole in a wellbore casing wherein the tools are less expensive to build and operate. In another of its aspects, the invention relates to a method and an apparatus for milling multiple holes in a wellbore casing without removing the cutting tools from the wellbore.

2. Description of Related Art

Hydrocarbon wellbore casings often have lateral holes milled in them using a small diameter motor-driven "knuckle" joint drive assembly with a bit on the leading end. The motor used is often a fluid-driven motor known as a mud motor, lowered on the end of standard coiled tubing. Once the holes are milled the milling equipment is removed, and the coiled tubing is subsequently used to lower a jet drilling assembly down to where it can be pushed out through the milled holes to drill into the surrounding well formation.

Using a motor-driven knuckle joint drive for the milling operation entails several problems for the operator. The lowered knuckle joint drive assembly is poorly stabilized during the cutting operation, requiring additional time to cut a hole in the casing. Lowering the knuckle drive assembly requires significant skill on the part of the operator, particularly when standard size coiled tubing is used, since the operator has virtually no "feel" over the milling operations and must depend on surface gauges hundreds or thousands of feet above to determine how to control the milling operation. Some of the available torque from the motor is expended on frictional drag resulting from the joint assembly rubbing against the inside of the deflector shoe, or resulting from the coiled tubing rubbing on the inside wall of the production tubing or "work string", making it even more difficult for the operator to know how much torque is available for the milling operation. Wellbores with increased deviation angle reduce the amount of weight that can be transferred to the bit via the knuckle drive for the milling operation. Small diameter knuckle joint assemblies cannot be used in high angle or horizontal wells; they make it difficult to know how much torque is really reaching the milling bit; and they make it difficult to know when the bit has completed milling a hole in the casing.

Alternatives to knuckle drive assemblies exist, but they also have drawbacks. One alternative is jointed pipe with a milling bit on the end, used in conjunction with a whipstock to drill a slot in the side of a wellbore casing. But conventional jointed pipe is time-consuming to put together and take apart on the surface, which is of particularly concern with wells drilled for hydrocarbon production because it results in high operating expense due to labor, rig rental, etc.

Another alternative uses coiled tubing to drive a jet nozzle using abrasive cutting fluids to cut a hole in the casing. But abrasive cutting fluid rapidly deteriorates and damages the pumping and metering equipment at the surface.

SUMMARY OF THE INVENTION

According to the invention, a bit-weighting "sub" assembly is provided at the lower end of coiled tubing during the milling operation, adjacent a mud motor. The sub transfers a known, constant weight to the bit through a rotary drive for the purpose of milling a hole in the casing in a relatively quick, controlled, cost effective manner.

In one embodiment, a bit-weighting sub is applied to a known type of milling assembly, for example, a deflector shoe milling assembly including (in order from the lower end up) a production tubing anchor, a deflector shoe with an orientation sub, and a rotary drive with a milling bit. In a preferred embodiment, the rotary drive includes a knuckle joint type drive assembly (hereafter "knuckle drive"). A motor including a Kelly shaft and bushing are lowered on the end of coiled tubing to couple with the knuckle drive and rotate the bit. In a one embodiment, the bit-weighting sub is mounted between the lower end of the coiled tubing and the upper end of the drive motor, and the motor can be considered part of the rotary drive since the bit-weighting sub applies its force to the milling bit through the motor. In another embodiment, the bit-weighting sub is mounted below the mud motor.

The bit-weighting sub comprises a spring-driven tubular support that applies a consistent amount of weight to the rotary drive. The bit-weighting sub is activated by lowering the coiled tubing to a "no-go" point in the workstring tubing, where it is stopped by complementary structure in the workstring when the weight of the coiled tubing compresses the bit-weighting sub's spring a pre-set amount. When the milling operation begins, i.e. when the rotary drive begins rotating the milling bit, the bit-weighting sub spring expands to apply a consistent amount of weight to the milling bit to advance the revolving bit through the casing. The weight of the coiled tubing is accordingly removed from the rotary drive and milling bit and the bit-weighting sub spring force controls the milling operation.

In another embodiment, the bit-weighting sub includes a housing, a Kelly-type non-rotating shaft, and a spring. The shaft is shaped to prevent rotation and has, for example, a square or hexagonal cross-section, or any other multi-sided shape that maintains the shaft in a linear path without rotating. Alternatively, the shaft can contain a key or keyway to prevent its rotation. Various types of springs, such as conventional coiled springs, Belleville springs, or leaf springs, can be used.

As a further embodiment, the bit-weighting sub can use a hydraulic lift, rather than a spring, to transfer weight to the milling bit.

As a preferred embodiment, the bit-weighting sub can be mounted to rotate with the motor and rotary drive when the sub is mounted below the motor.

Further according to the invention, a method of milling a hydrocarbon wellbore casing wherein a rotary drive with a milling bit and a motor are lowered by tubing down the wellbore to rotate the milling bit to form a hole in the casing comprises controlling the force exerted on the milling bit through the rotary drive during the milling operation.

In one embodiment, the act of controlling the force on the milling bit comprises removing the weight of the tubing from the rotary drive and milling bit after the motor has been landed in operative connection with the rotary drive and is ready to mill a hole in the casing. Further, a milling force is exerted on the milling bit through the rotary drive, independent of the weight of the tubing. Thereafter, the motor is operated to rotate the rotary drive and milling bit under the milling force to form a hole in the wellbore casing.

These and other features and advantages of the invention will become apparent from the detailed description below, in light of the accompanying drawings.

DESCRIPTION OF THE PREFERRED EMBODIMENT

Figure 1:
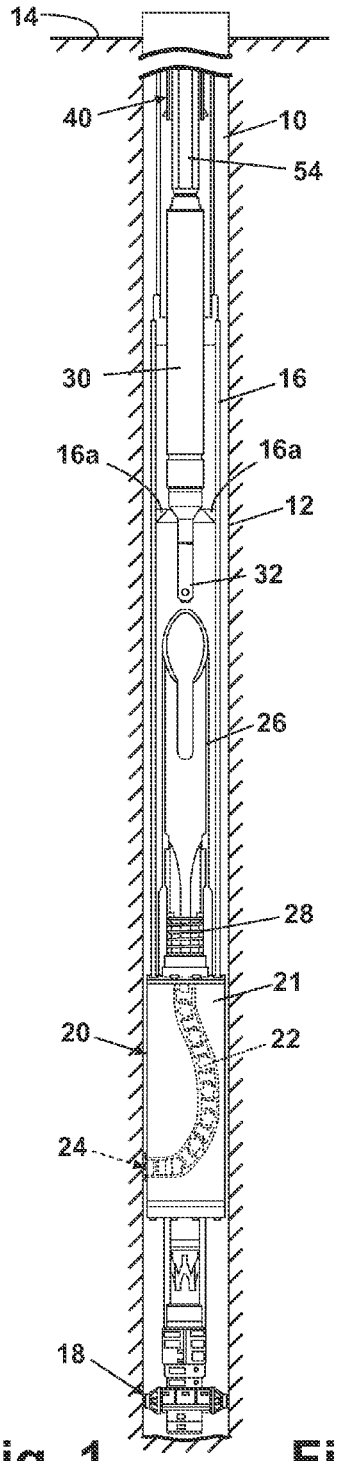
FIG. 1 is a schematic representation of a casing milling assembly containing the bit-weighting sub according to the invention as it is lowered into a wellbore.

Referring now to the drawings and to FIG. 1 in particular, a deflector shoe milling assembly 20 is mounted in a hydrocarbon wellbore 10 for milling wellbore casing 12 using a knuckle drive 22 with a bit 24 on its leading end inside a deflector shoe 21. The deflector shoe 21 is anchored relative to casing 12 using a tubing anchor 18. Deflector shoe 21 has an orientation sub 26 on its upper end to receive a mud motor 30 and a motor-driven Kelly drive shaft 32 that engages a Kelly bushing 28 of known type on the upper end of the knuckle drive 22. Mud motor 30 is lowered into the wellbore from surface 14 on the end of standard coiled tubing T (visible in FIGS. 2 and 3) until shaft 32 is operatively coupled to knuckle drive 22, and then fluid pumped from the surface drives the motor to rotate the bit 24 through a rotary drive that includes the shaft 32 and knuckle drive 22 to cut a hole in casing 12.

The deflector shoe milling assembly 20, which is not part of the present invention, and which can be the type disclosed in WO 2007/067544, which is incorporated herein by reference in its entirety, is used to re-orient the milling bit for milling multiple holes in the casing 12 at the anchored depth. It will be recognized that alternative devices for orienting the knuckle drive 22 and milling bit 24 relative to casing 12 known in the art and can be used for the milling operation. Alternative devices for applying rotary power to the milling bit will also be known, for example, using a turbine drill with a speed reducer in lieu of a mud motor. Various modifications to the rotary drive can be made, for example, placing the Kelly shaft in the deflector 20 and the mating Kelly bushing above. The knuckle drive 22 can be coupled to the mud motor at the surface and lowered into the deflector, instead of residing in the deflector. The invention is believed to be suitable for use with these and other such alternatives and modifications to the structural environment in which a rotary drive is lowered on tubing to rotate a milling bit against the wellbore casing to form a hole, and should not be limited to the specific milling assembly shown in the illustrated example.

The milling assembly described up to this point is already known and further detail will be omitted as being unnecessary for an explanation of the invention.

The present invention resides in a "weight on bit" or bit-weighting sub 40 associated with the mud motor 30 on the end of the coiled tubing. In FIG. 1, the bit-weighting sub 40 is supported by the coiled tubing T and is positioned above the mud motor 30 and knuckle-driving Kelly shaft 32.

Figure 2:
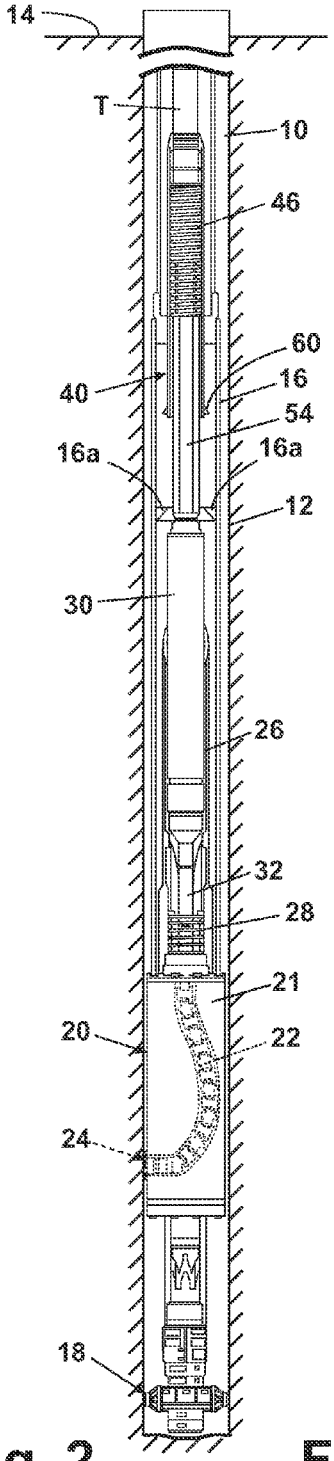
FIG. 2 is a view of the casing milling assembly of FIG. 1 with its rotary drive assembly landed in the deflector shoe before weight is applied to the bit-weighting sub.
Figure 3:
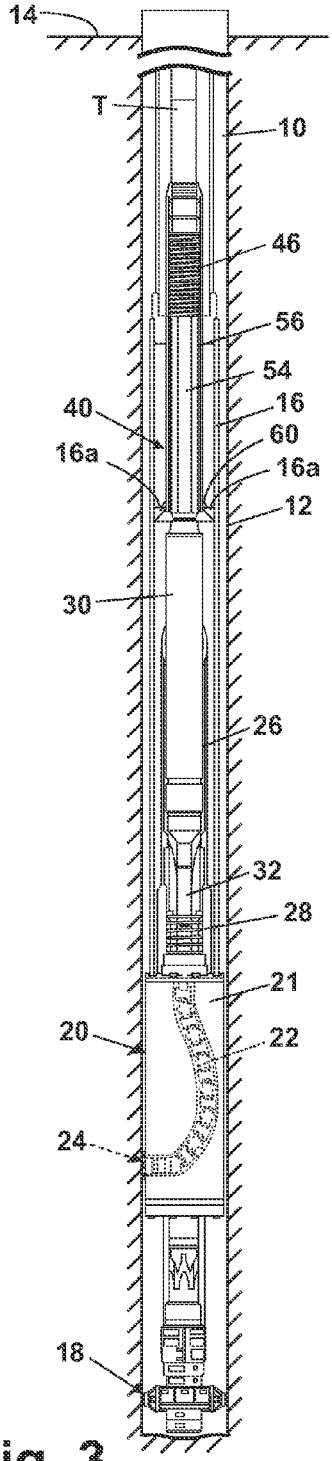
FIG. 3 is a view of the casing milling assembly of FIGS. 1 and 2 as weight is applied to the bit-weighting sub in the landed condition of FIG. 2, compressing the internal bit-weighting spring prior to the start of milling operations.

Referring to FIGS. 2 and 3, coiled tubing T is shown lower in the well casing 10 to land the mud motor 30 and Kelly shaft 32 in rotary driving engagement with knuckle drive 22 in deflector shoe 20. In the illustrated example, the knuckle drive 22 rests in the deflector shoe 21 and is disengaged from the mud motor 30. The coupling between the Kelly shaft 32 and knuckle drive 22 can be a locking mechanism, for example, using known locking dogs. Alternately, the coupling can be made non-locking by leaving the typical spring-loaded dogs out of the assembly, disconnecting the motor 30 from the knuckle drive 22, for example, when the motor is removed by the coiled tubing to re-orient the milling bit, or for a subsequent jet drilling operation through the newly milled hole in casing 12. Mud motors and Kelly shaft/bushing structures and equivalents for giving rotary motion to knuckle drives are well known in the art, and further detail will be omitted.

As shown in FIGS. 2 and 3, bit-weighting sub 40 is connected between the lower end of coiled tubing T and the upper end of mud motor 30. Sub 40 includes a sliding, non-rotating hex Kelly shaft 54 connected in fixed manner to the upper end of the mud motor 30, for example, with a threaded connection or set screws or pins, and a bit-weighting spring 46 between the mud motor 30 and the coiled tubing T. Kelly shaft 54 is mounted to slide up and down a limited distance within the bit-weighting sub's housing 56. FIG. 2 shows the spring 46 in an uncompressed state, just as the mud motor 30 and knuckle-driving Kelly 32 land in a landing profile of orientation sub 26 to couple with knuckle drive 22 in deflector shoe 20. FIG. 3 shows sub spring 46 compressed as weight from the coiled tubing T is set down on the bit-weighting sub; i.e., as the coiled tubing is lowered further from the position in FIG. 2, until a no-go projection 60 on the lower end of the bit-weighting sub's housing 56 abuts a no-go profile 16*a* in tubing 16, positively stopping the upper end of sub 40 (and thus the coiled tubing T) from being lowered any further. The no-go profile 16*a* can be a ring or a series of circumferentially spaced projections welded or otherwise fastened to the interior surface of the production tubing 16 before the production tubing is lowered into the well casing 10.

Once the mud motor 30 is landed and bit-weighting sub spring 46 is compressed against the stationary knuckle drive 22 as shown in FIG. 3, fluid can be pumped down the coiled tubing to drive (rotate) the mud motor 30 in known manner to begin rotating the bit 24 on the end of knuckle drive 22. It may be preferred to slightly lift the coiled tubing T from this position before starting motor 30, for example, a few inches, and then lower it back down to begin milling a hole through casing 12.

Figure 4:
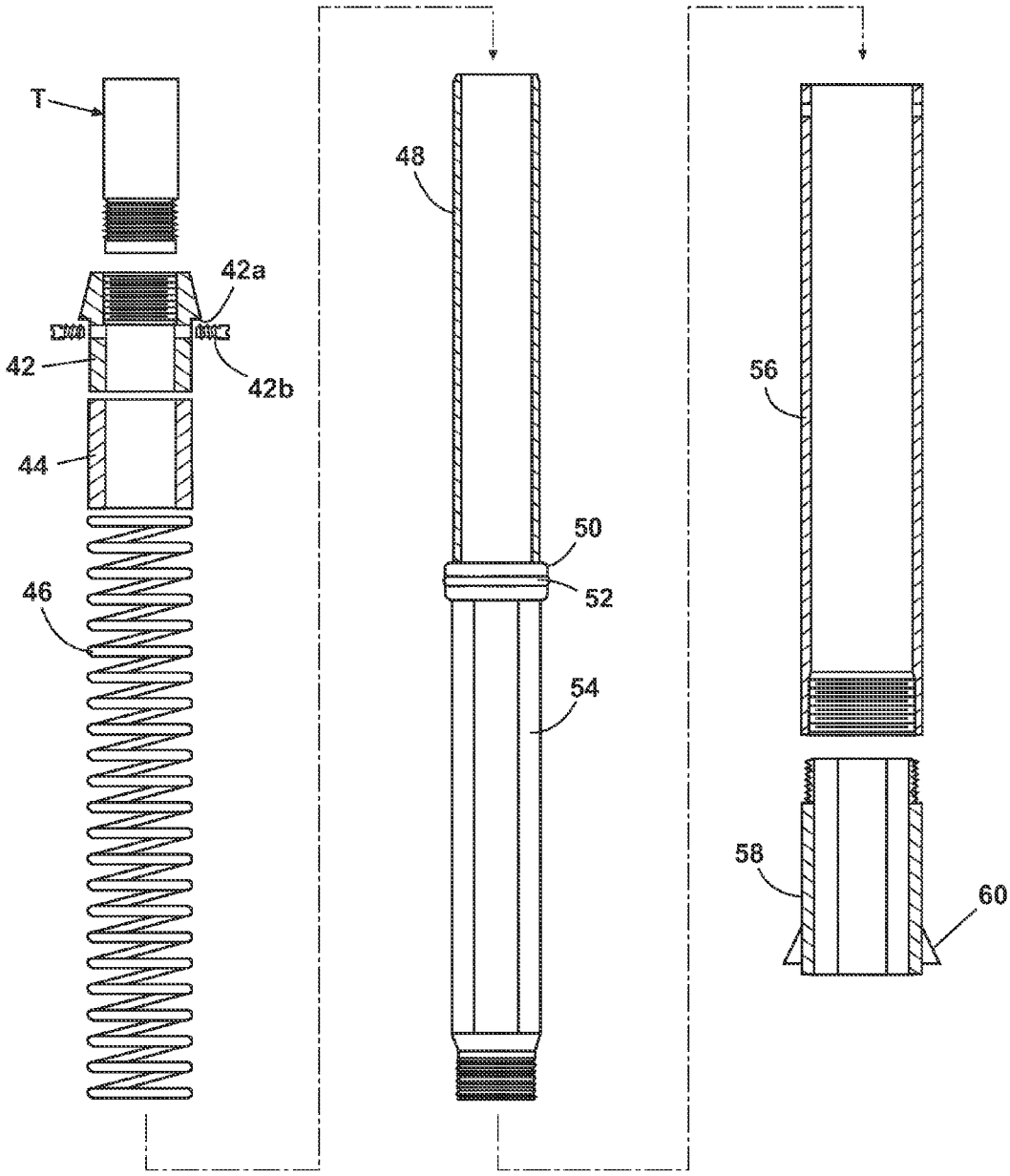
FIG. 4 is an exploded view of the parts of the bit-weighting sub of FIGS. 1-3 relative to the lower end of standard coiled tubing.
Figure 5A:
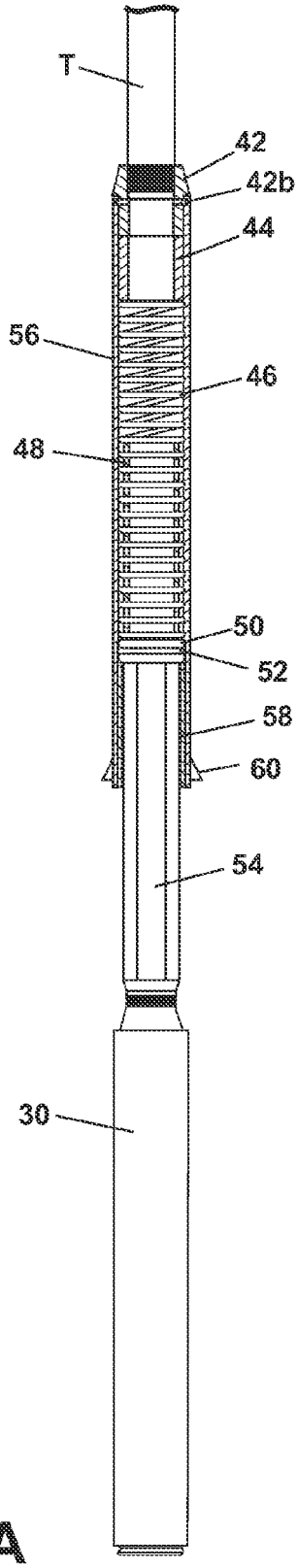
FIG. 5A is a side elevation view of the bit-weighting sub of FIGS. 1-4 secured between the lower end of the coiled tubing and the upper end of the mud motor, with the sub spring uncompressed.
Figure 5B:
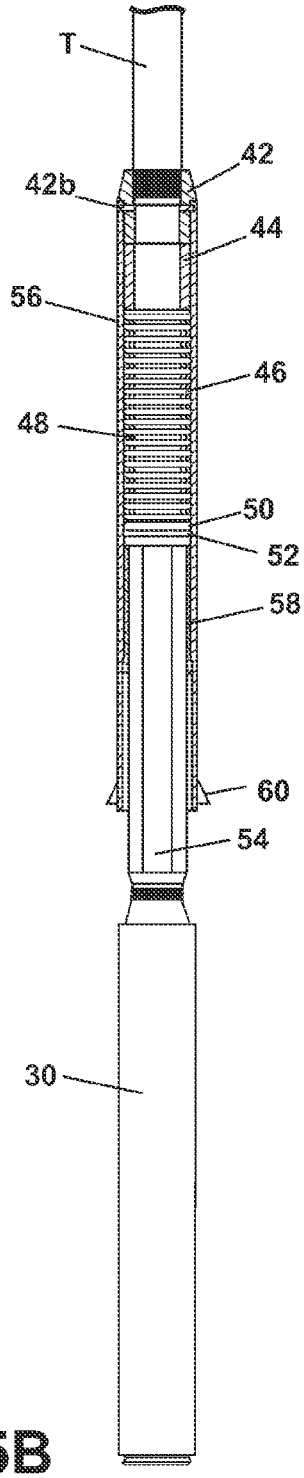
FIG. 5B is a side elevation view similar to FIG. 5A, but showing the coiled tubing in a lower position to weight the sub and compress the spring.

FIGS. 4 and 5A-5B illustrate the bit-weighting sub 40 in more detail. In the illustrated embodiment, bit-weighting sub 40 includes an upper cap 42 secured to the lower end of coiled tubing T with a connection such as a threaded connection. Cap 42 has a shoulder or stop 42*a* that rests on the upper end of upper housing 56 and is secured thereto through screws 42*b* or by a threaded connection (not shown). A spacer ring 44 can be used to adjust the amount of compression applied to spring 46. Spring 46 fits axially over a centralizer sub 48, inside housing 56, with the lower end of spring 46 seated on a ring 50. Ring 50 has a seal 52, for example, an O-ring, in sliding contact with the inner wall of the housing 56. Centralizer sub 48 includes a lower Kelly shaft portion 54, in the illustrated embodiment a hex Kelly, although any multi-sided or keyed shape or structure that can permit shaft 50 to slide longitudinally but prevent it from rotating with respect to housing 56 can be used. Upper housing 56 mounts a lower housing 58 that has a hexagonal (or multi-sided or similar) interior shape to receive hex Kelly 48 with an axially-sliding but non-rotating fit. The lower housing 58 includes a no-go radial projection 60 that is configured to abut a corresponding no-go internal projection or abutment 16*a* in tubing 16, as best shown in FIG. 3. The radial projection 60 can be annular or circumferentially spaced individual pieces. Likewise, the no-go internal projection or abutment 16*a* can be annular or circumferentially spaced individual pieces.

Figure 6:
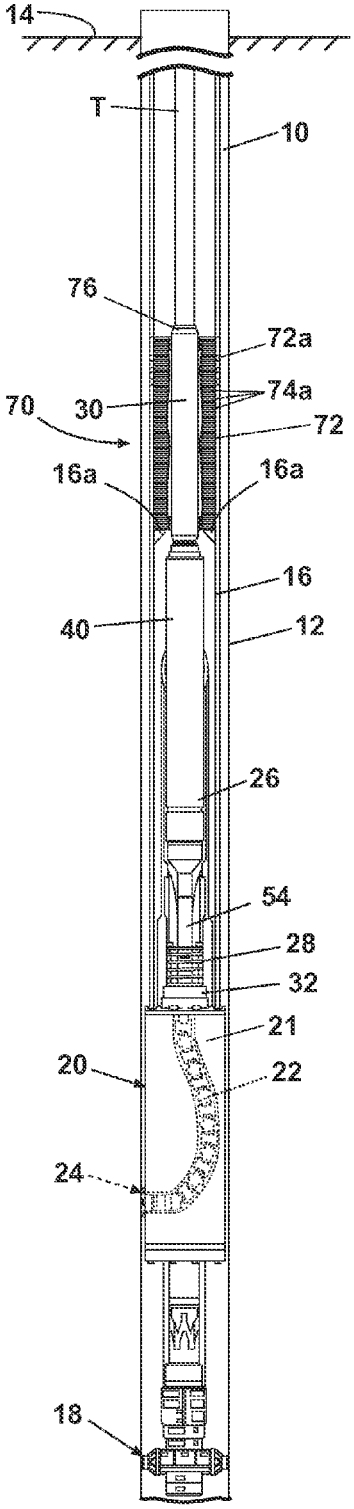
FIG. 6 is a schematic side elevation view of a casing milling assembly similar to FIG. 3 but with an alternate position for the bit-weighting sub, mounted below the mud motor.

While the illustrated embodiment in FIGS. 1 through 5 show bit-weighting sub 40 mounted between the coiled tubing T and mud motor 30 (above the motor), it is also possible to mount bit-weighting sub 40 between the mud motor and knuckle drive 22 (below the motor) as shown in FIG. 6. Whereas above-motor bit-weighting sub 40 in FIGS. 1-5 is non-rotational, it is preferred that below-motor sub 40 in FIG. 6 is attached to rotate with the lower end or drive shaft of motor 30. It is also possible to mount sub 40 below the motor so that a rotational drive element passes through sub 40 without rotating the bit-weighting sub itself, but it has been found that rotating sub 40 with the motor improves the milling operation.

Figure 7:
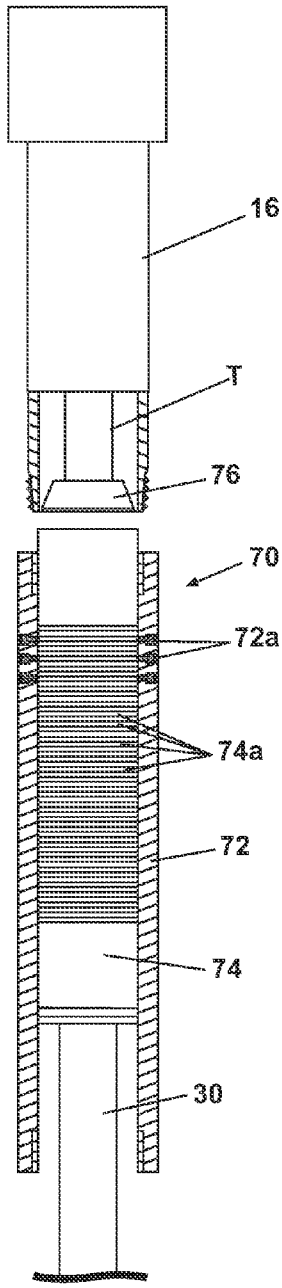
FIG. 7 is an enlarged side elevation view of a portion of the casing milling assembly of FIG. 6 and illustrating a preferred no-go structure for the below-motor mounting arrangement of FIG. 6.

FIG. 7 illustrates an alternate no-go structure 70 especially useful for the below-motor mounting of FIG. 6. No-go structure 70 includes an oversize tubular adapter 72 that is threadably mounted between two sections of the workstring tubing 16, a no-go sleeve 74 with adjustment grooves 74*a*, and a sub 76 threaded to the upper end of motor 30 and threaded to a lower end of the coiled tubing T. The no-go sub 76 has an outer diameter that is adapted to abut the upper end of the sleeve 74 to positively stop motor 30 (and thus the coiled tubing T used to lower the motor) against the upper end of sleeve 74. The tubular adapter 72 is threaded to the adjacent sections of the workstring tubing 16 at the well head prior to lowering the workstring 16 into the well bore 10. In the illustrated embodiment, setscrews are inserted through holes 72*a* to project into grooves 74*a* on sleeve 74 when the sleeve is in the desired position. It will be understood that while no-go structure 70 is preferred when the bit-weighting sub 40 is mounted below motor 30, the no-go structure 16*a* and 42 shown in FIGS. 1-5 could also be adapted to a below-motor mounting of sub 40. Further, the no-go structure 70 in FIG. 7 can be adapted to an above-motor mounting of the bit-weighting sub, replacing the no-go profile 16*a* in workstring tubing 16.

Still referring to FIGS. 6 and 7, coiled tubing T lowers motor 30 down through adapter 72 and no-go sleeve 74 into operative connection with the knuckle drive 22 in deflector shoe 21. The spring in bit-weighting sub 40 below motor 30 is compressed until no-go cap 76 on the upper end of motor 30 and on the lower end of the coiled tubing T stops against the upper end of no-go sleeve 74, at which point the weight of the coiled tubing is taken off sub 40 and knuckle drive 22. The bit-weighting sub spring alone will then apply pressure to the milling bit 24 for the milling operation.

Figure 8A:
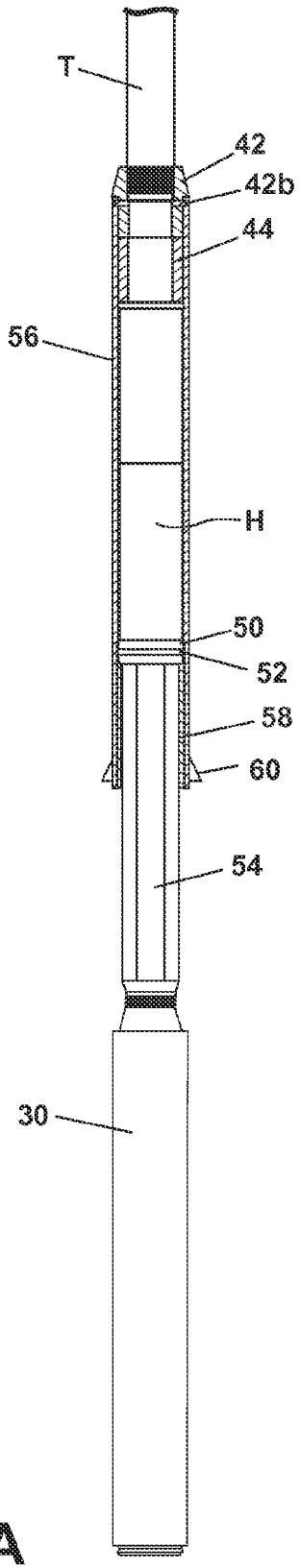
FIG. 8A is a view similar to FIG. 5A, but schematically illustrates a hydraulic force-exerting structure in place of a spring in the bit-weighting sub.
Figure 8B:
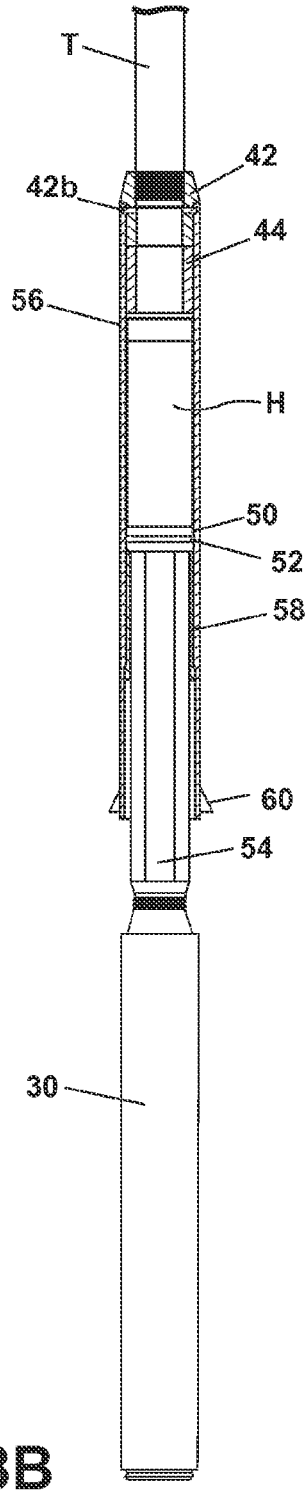
FIG. 8B shows the hydraulic bit-weighting sub of FIG. 8A with the hydraulic force-exerting structure in a bit-weighting condition.

As mentioned previously, it is possible to replace the known, controllable spring force of the bit-weighting sub spring 46 with a hydraulic force-exerting structure operated with the fluid pumped down coiled tubing T, or with an independent fluid supply delivered downhole. Such hydraulic force-exerting structure is illustrated at H in FIGS. 8A and 8B, with FIG. 8B schematically representing the hydraulic structure H in a bit-weighting condition. Once the motor 30 is landed in operative connection with knuckle drive 22, hydraulic fluid could be forced downhole to operate the hydraulic force-exerting structure H in the bit-weighting sub to apply milling pressure to the bit in a manner similar to the illustrated spring in FIGS. 5A and 5B.

While the invention has been illustrated in use with a rotary drive lowered and operated through standard coiled tubing, it will be understood that the invention could also be used with other types of tubing such as jointed tubing.

The invention provides an apparatus and a method to drill one or more holes in a wellbore casing quicker than is possible with prior apparatus. The invention reduces the skill required by operators to drill a hole in a wellbore casing with minimal problems. Further, the invention provides a preset amount of force to be constantly applied to the bit as it is milling a hole in the casing. Further, the casing can be milled in deviated or horizontal wells. Still further, the casing can be milled in flowing wells and further can be milled in the casing at depths which are greater than currently possible with prior apparatus. Further, the required torque on the motor is reduced because the milling assembly does not have to support the weight of the coiled tubing. The invention provides for holes to be milled in casing using standard size coiled tubing units.

It will finally be understood that the disclosed embodiments are representative of presently preferred forms of the invention, but are intended to be illustrative rather than definitive of the invention. Reasonable variation and modification are possible within the scope of the foregoing disclosure and drawings without departing from the spirit of the invention.

What is claimed:

1. In a hydrocarbon wellbore assembly comprising:

a casing;

a casing milling assembly including a rotary drive with a milling bit positioned at a hydrocarbon producing strata beneath the surface of the earth within the casing;

a motor within the wellbore operably coupled to the rotary drive to rotate the milling bit to form a hole in the casing, and a tubing extending from the surface of the earth and coupled to the motor;

an assembly for controlling the force exerted on the milling bit through the rotary drive during the milling operation, comprising:

a no-go stop in the wellbore configured for supporting the tubing at a predetermined depth in the wellbore when the motor is operatively coupled with the rotary drive; and a bit-weighting sub coupled at an upper end to the tubing and at a lower end to the rotary drive, the bit-weighting sub having upper and lower portions that are mounted for axial movement with respect to each other to alter the length of the sub from an extended position to a retracted position to thereby alter the distance between the lower end of the tubing and the upper end of the rotary drive, and a device for biasing the upper and lower portions of the bit-weighting sub to the extended position to thereby exert a milling force on the milling bit independent of the weight of the tubing.

2. The hydrocarbon wellbore assembly of claim 1, wherein the tubing is coiled tubing.

3. The hydrocarbon wellbore assembly of claim 1, wherein the device for biasing the upper and lower portions of the bit-weighting sub to the extended position comprises a spring.

4. The hydrocarbon wellbore assembly of claim 1, wherein the device for biasing the upper and lower portions of the bit-weighting sub to the extended position comprises a hydraulic force-exerting structure.

5. The hydrocarbon wellbore assembly of claim 1, wherein the bit-weighting sub is connected between a lower end of the tubing and an upper end of the motor.

6. The hydrocarbon wellbore assembly of claim 1, wherein the bit-weighting sub is connected between a lower end of the motor and the rotary drive.

7. The hydrocarbon wellbore assembly of claim 6, wherein the bit-weighting sub is operably connected to the rotary drive.

8. The hydrocarbon wellbore assembly of claim 1, wherein the no-go stop is associated with a workstring tubing through which the motor and bit-weighting sub are lowered.

9. The hydrocarbon wellbore assembly of claim 8, wherein the no-go stop comprises an abutment profile in the workstring tubing that corresponds with a no-go profile associated with the bit-weighting sub.

10. The hydrocarbon wellbore assembly of claim 9, wherein the no-go stop further comprises a sleeve mounted in the workstring tubing that corresponds with a no-go profile associated with the motor.

11. The hydrocarbon wellbore assembly of claim 1, wherein the rotary drive is a knuckle drive.

12. A method of milling a hydrocarbon wellbore casing, wherein a motor is lowered by tubing down the wellbore to rotate a milling bit to form a hole in the casing, the method comprising:

controlling the force exerted on the milling bit through a rotary drive during the milling operation by removing the weight of the tubing from the rotary drive and milling bit by stopping the tubing against a no-go in the wellbore after the motor has been placed in operative connection with the milling bit through the rotary drive and is in place to mill a hole in the casing;

exerting a milling force on the milling bit through the rotary drive, independent of any further downward movement of the lower end of the tubing with a compression spring force between the rotary drive and the tubing; and operating the motor to rotate the rotary drive and milling bit under the milling force to form a hole in the wellbore casing.

* * * * *